US005090590A

United States Patent [19]

Hoffman

[11] Patent Number: 5,090,590

[45] Date of Patent: Feb. 25, 1992

[54] ACCESS DELAY MECHANISM

[76] Inventor: Arlan J. Hoffman, 5137 Coldbrook Dr., Mantua, Ohio 44255

[21] Appl. No.: 628,704

[22] Filed: Dec. 17, 1990

[51] Int. Cl.[5] ..... B65B 59/00

[52] U.S. Cl. ..... 221/15; 221/193; 221/210; 221/220; 221/262

[58] Field of Search ..... 221/15, 16, 193, 195, 221/196, 210, 220, 262

[56] References Cited

U.S. PATENT DOCUMENTS

| | | | |
|---|---|---|---|
| 658,517 | 9/1900 | Stone | 221/220 |
| 2,240,389 | 4/1941 | Campbell et al. | 221/16 |
| 2,279,093 | 4/1942 | Peters | 221/15 |

FOREIGN PATENT DOCUMENTS

| | | | |
|---|---|---|---|
| 1414271 | 9/1965 | France | 221/16 |
| 24500 | 1/1963 | German Democratic Rep. | 221/210 |

OTHER PUBLICATIONS

Vending Service Inc., Louis Weisz, Airpot gives you better motion control, pages 1, Oct. 24, 1990.

Vending Service Inc., Airport Dashpot Series 56, p. 2, Oct. 24, 1990.

*Primary Examiner*—H. Grant Skaggs

*Attorney, Agent, or Firm*—D. Peter Hochberg; Mark Kusner; Louis J. Weisz

[57] ABSTRACT

A limited access container that limits the rate at which articles can be withdrawn therefrom includes a retrieval rod which extends through the top cover of the container and which has an article-holding implement on the lower end thereof. After securing an article thereto, the rod is lifted to the top of the container and the article passed through a slotted horizontal passageway to a vertical shaft down which it is lowered to a point adjacent a container opening for removal of the article. A pivotable lever is located adjacent the passageway having a passageway blocking member on one end, and a blocking-activating member on the other end. A spring urges the lever to pivot so that the blocking-activating member extends through the slot into the passageway, while movement of an article through the passageways results in contact between the blocking-activating member and the article, allowing the article to pass, but causing the lever to pivot so that the article blocking member enters the slot into the passageway, temporarily preventing the passage of further articles therethrough. A pneumatic dashpot attached to the lever allows the spring to move the blocking member out of the passageway after a predetermined interval of time, resetting the lever mechanism.

10 Claims, 5 Drawing Sheets

ACCESS DELAY MECHANISM

TECHNICAL FIELD

This invention relates to a mechanism which limits the number of articles that can be withdrawn from a container within a given time period. More particularly, this invention relates to a mechanism that imposes a minimum time interval between the withdrawal of successive articles from a limited access container. Specifically, this invention relates to a mechanism that temporarily blocks the removal of additional articles from a limited access container after one of the articles has been withdrawn therefrom. To achieve such results, the mechanism depends upon the action of a blocking device whose operative blocking period is time-dependent, continuing until the blocking action of the device is no longer operative as a consequence of the passage of a predetermined interval of time.

BACKGROUND OF THE INVENTION

Increasingly, companies have come to depend upon the distribution of discounted products to the public in order to acquaint prospective purchasers with the merits of their products, and to otherwise stimulate sales. Such discounts often take the form of coupons good for credit at the time of purchase, or rebates redeemable thereafter. Such merchandising methods have become particularly important to vendors of food products since the nature of such products can basically only be determined by a taste test, as opposed to visual inspection.

While coupon redemption and rebating has become a valuable merchandising tool for fostering enhanced retail sales, the dispensing of free samples has also become increasingly common. Sample giveaways provide particularly powerful sales stimulation since the buying public is strongly attracted to any offer of free merchandise.

Free samples can sometimes take the form of a limited quantity of product mailed directly to the consumer, or they are often provided by company representatives passing the samples out directly to passersby in public areas. While both methods have proven effective, they suffer from certain inherent drawbacks. For example, packaging and mailing costs have risen steadily in the past, as have wages required in the case of distribution by representatives. In addition, it is often difficult to target the most promising segment of the buying public with such methods, making it necessary to distribute samples to the public indiscriminately, proportionately increasing the cost of reaching a desired market.

In the case of some products, it has been found that distribution at the point of sale provides the most efficient way in which to distribute free samples since the individuals most likely to be receptive to the product are the only ones to whom distribution is made. Furthermore, distribution can be carried out without any need to engage special personnel for the purpose.

Where the dispensing of samples is carried out at the point of sale, it is commonly done by providing a container filled with the product being given away at the point of sale location, for example, placed on the counter or a pedestal. Individuals patronizing the location simply help themselves to the samples made available to them. Such a system works particularly well in the case where small articles are to be distributed, such as candy mints, chewing gum, and similar articles. Unfortunately, however, providing unrestricted access to such products to members of the public can also present problems. For example, some individuals take the opportunity to help themselves to more than a single sample, often taking a handful or more. Such behavior is frequently not deterred by signs, or even by social pressure, and it causes such sample distribution methods to be prohibitively expensive.

BRIEF DESCRIPTION OF THE INVENTION

In view of the preceding, therefore, it is a first aspect of this invention to provide an inexpensive method for distributing product samples.

A second aspect of this invention is to provide a mechanism for dispensing free samples of merchandise to the public for product promotional purposes.

Another aspect of this invention is to provide a mechanism for controlling the rate at which articles can be withdrawn from a container.

A further aspect of this invention is to provide a manually operated mechanism that limits the amount of free samples that an individual can remove from a limited access container within a particular time period.

An additional aspect of this invention is to provide a mechanism that establishes minimum time intervals between successive withdrawals of product from a limited access container.

A still further aspect of this invention is to provide a blocking device that prevents articles from being withdrawn from a limited access container until a predetermined period of time has elapsed since the last article was withdrawn.

Yet another aspect of this invention is to provide a sample dispensing mechanism that limits the act of sample withdrawal to a single sample, and provides a time delay before the next sample can be removed.

The foregoing and other aspects of this invention are provided by a limited access container that controls the rate of withdrawal of articles therefrom comprising: a limited access container; article transport means; article blocking means; spring means; and unblocking delay means. In the process of withdrawal, the articles must be removed by the transport means along a passageway to an opening communicating with the outside of the container. The article blocking means provided are pivoted between a blocking position preventing movement of the articles through the passageway, and an unblocking position permitting such movement. The movement of the articles through the unblocked passageway pivots the blocking means into an article-blocking position, and the spring means subsequently automatically pivots the article blocking means back into an article unblocking position after an interval of time determined by the unblocking delay means has elapsed.

The foregoing and additional aspects of the invention are provided by a limited access container that controls the rate of withdrawal of articles therefrom comprising: a limited access container; article transport means; article blocking means; spring means; and unblocking delay means. The article blocking means comprises a pivotable lever having a passageway blocking member and a blocking-activating member, the lever being pivotable about a pivot point. The lever is connected to the spring means which urges the lever to pivot into an unblocking position, and the lever is also connected to the unblocking delay means which delays such pivoting. The unblocking delay means comprises a pneumatic dashpot, while the article transport means comprises a rod having an article-holding implement fixed to its lower end, and the limited access container has a top cover provided with a slot passing through the center thereof dimensioned to receive the rod. Articles withdrawn from the container must be moved by the article transport means through a passageway to an opening communicating with the outside of the container, thereby causing the lever to pivot into a blocking position where it remains for a period predetermined by the unblocking delay means. The passageway is disposed immediately below the top cover and is structured to receive the described members on the interior thereof.

The foregoing and further aspects of this invention are provided by a passageway that controls the rate at which articles can be moved therethrough comprising: a passageway; article transport means; article blocking means; spring means; and unblocking delay means. The article blocking means comprises a pivotable lever having a passageway blocking member and a blocking-activating member, the lever being pivotable about a pivot point. The lever is connected to the spring means which urges the lever to pivot into an unblocking position, while the unblocking delay means acts to delay such pivoting. The unblocking delay means comprises a pneumatic dashpot, and articles moved through the passageway by the article transport means cause the lever to temporarily pivot into a blocking position, the passageway being structured to receive the described members on the interior thereof.

BRIEF DESCRIPTION OF THE DRAWINGS

The invention will be better understood when reference is had to the following drawings, in which like-numbers refer to like-parts, and in which.

DETAILED DESCRIPTION OF THE INVENTION

Figure 1:
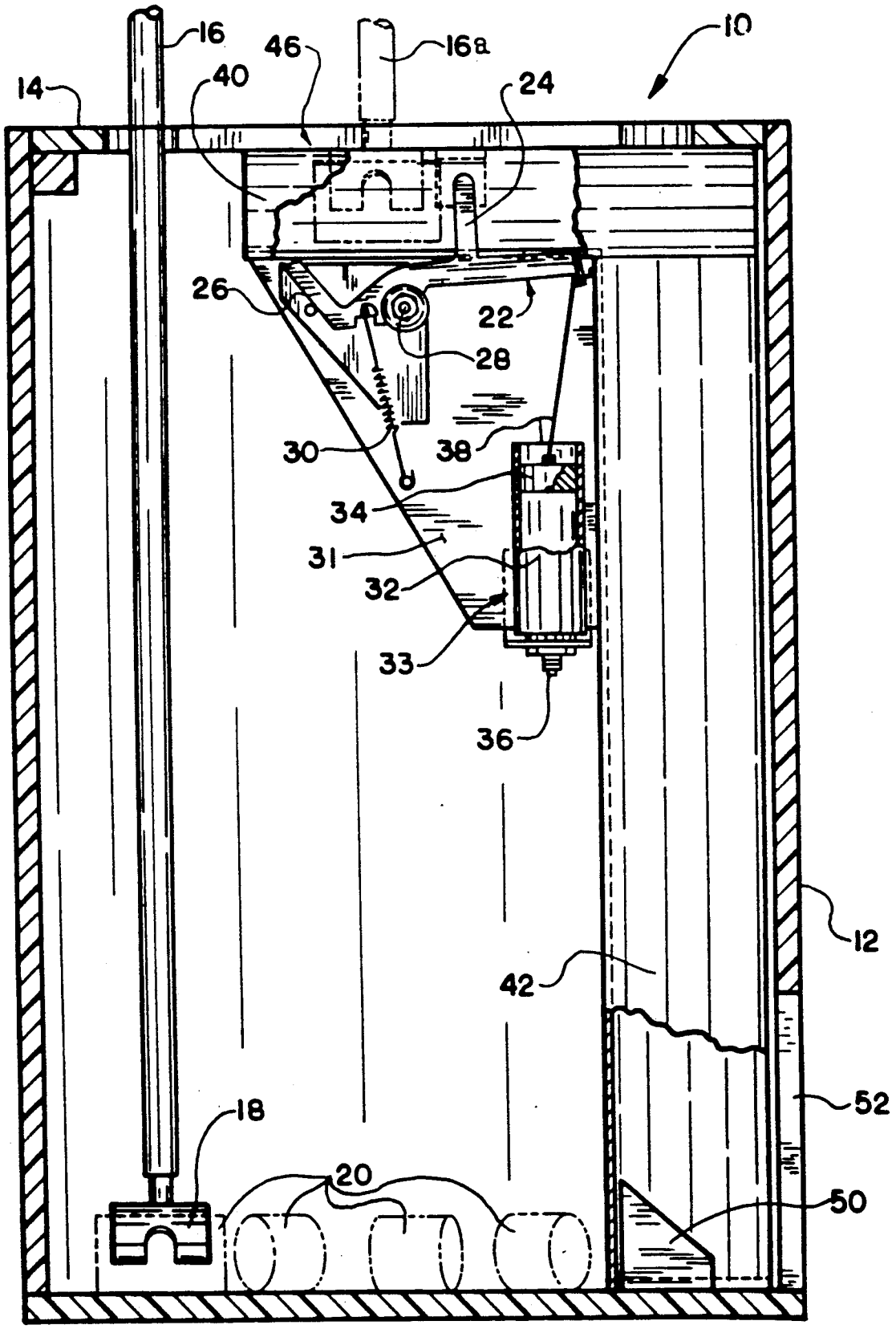
FIG. 1 is a side elevation sectional view of a limited access container of the invention along line 1—1 of FIG. 3, showing the container in its unblocked mode.
Figure 3:
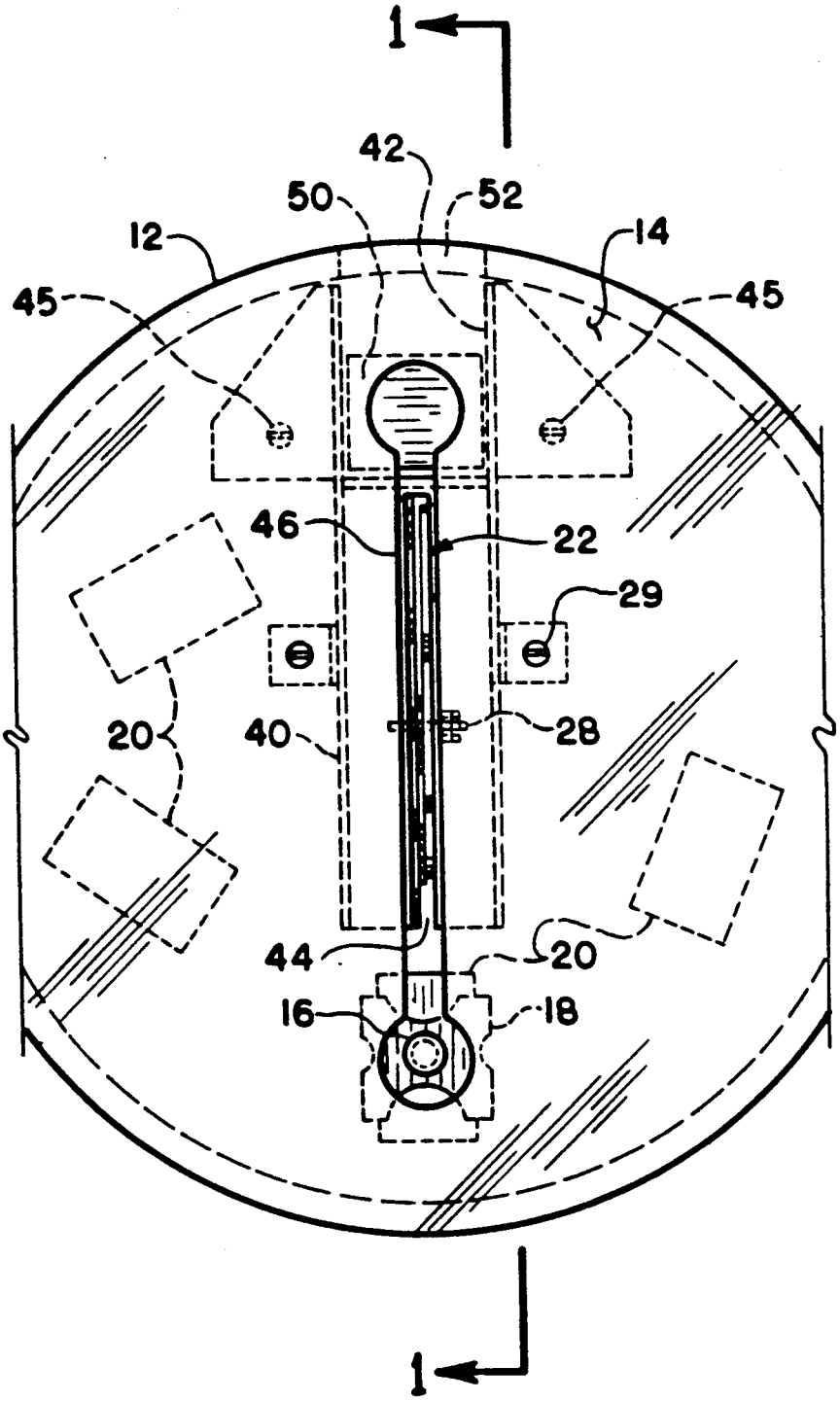
FIG. 3 is a top view of the container of FIG. 1.

FIG. 1 is a side elevation sectional view of a limited access container of the invention, generally 10, along line 1—1 of FIG. 3, showing the container in its unblocked mode. As illustrated, a container 12 is provided with a top cover 14, containing the articles, for example, rolled mints 20 to be dispensed therefrom. Positioned beneath the cover of the container 14 is an article transport passageway 40, connected at right angles to an article access shaft 42, the passageway and shaft having a gusset plate 31 mounted therebetween. A lever 22, including a passageway blocking member 26 and a blocking-activating member 24 is fastened to gusset plate 31 at a pivot point 28. Also fastened to gusset plate 31 is a pneumatic dashpot 33 comprising a cylinder 32 having a piston 34 disposed therein, and an adjustable orifice 36 located at the bottom of the cylinder for the purpose of admitting air thereto. The piston 34 is connected by means of cylinder rod 38 to one end of lever 22. The other end of the lever 22 is connected to one end of the spring 30, the opposite end of the spring being anchored to the gusset plate 31. An article retrieval rod 16 is shown extending through cover-slot 46, better seen in FIG. 3, into container 12. The retrieval rod has an article-holding implement 18 fastened to the bottom thereof, which in the Figure is shown holding a roll of mints 20, with additional rolls being disposed on the bottom of the container.

Figure 2:
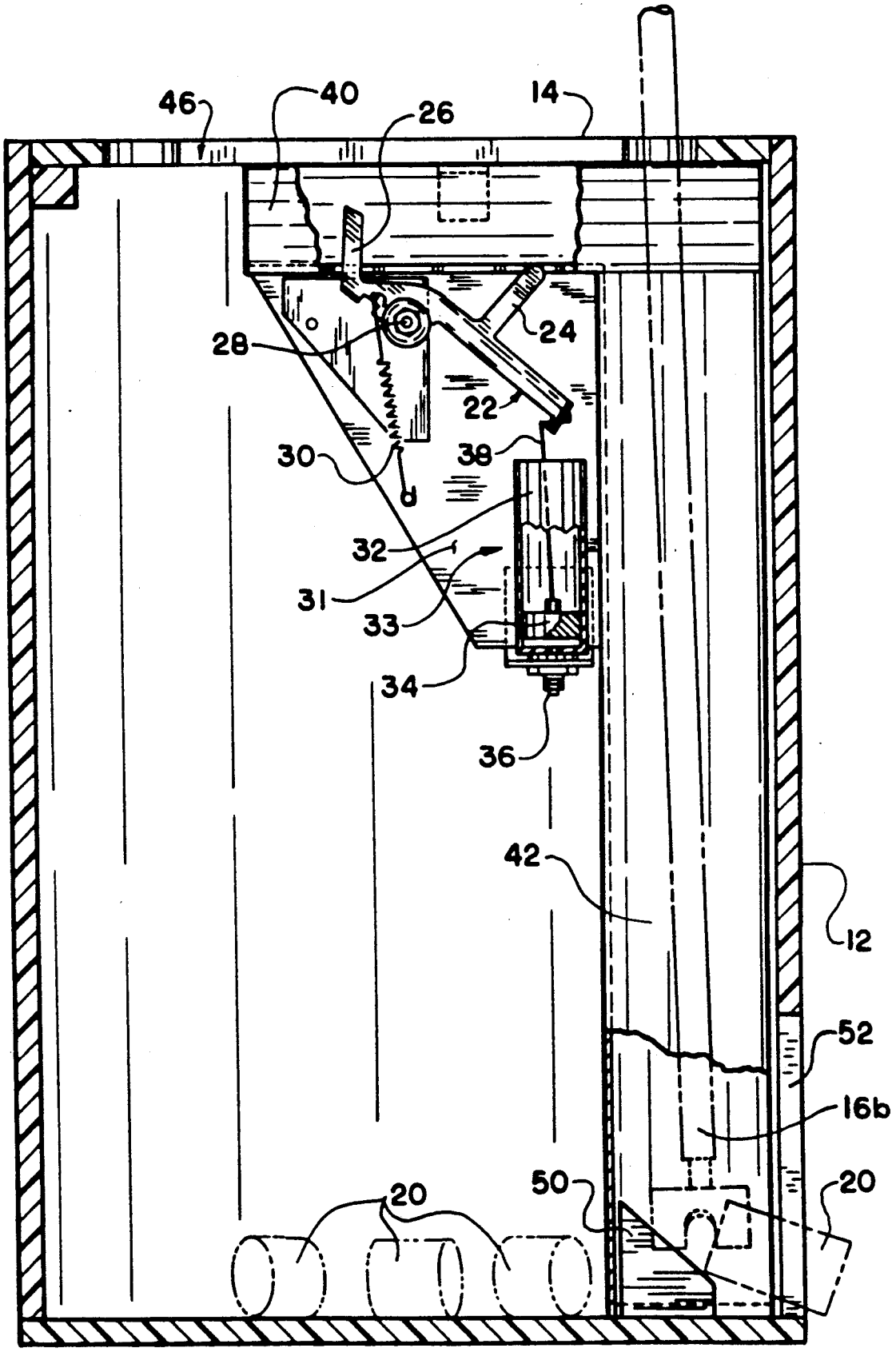
FIG. 2 is a view of the container of FIG. 1 in its blocked mode.

Also shown in FIG. 1, in phantom, is retrieval rod **16*a* positioned in the article transport passageway 40. FIG. 2 shows a further phantom view of the retrieval rod 16*b*, illustrating positioning of the rod in article access shaft 42, adjacent to access opening 52. Mounted at the bottom of the article access shaft is an article disengaging ramp 50 which assists in the removal of the article from the holding implement 18**.

Articles are dispensed from the container in a sequence of steps as follows. Retrieval rod 16 is positioned above the article to be dispensed, in the case of the Figure, a roll of mints 20, and the holding implement, as shown a semi-circular clip, is forced downward over the mints, securing them to the rod. The retrieval rod 16 is thereafter lifted until the article being transported is adjacent the open end of the article transport passageway 40, after which the rod is moved through the passageway, as shown in phantom **16*a*. As the retrieval rod passes through the passageway, it necessarily engages blocking-activating member 24, pivoting it clockwise in the Figure against the urging of spring 30 attached to lever 22, of which the blocking-activating member forms a part. As lever 22 pivots, it causes passageway blocking member 26, also attached to the lever, to rotate in a clockwise direction, entering article transport passageway 40 through a passageway slot 44, better seen in FIG. 3. Also, as lever 22 pivots, the cylinder rod 38 to which it is attached forces piston 34 to the lower end of cylinder 32 of the dashpot 33**.

FIG. 2 is a view of the container of FIG. 1 in its blocked mode. The Figure illustrates the point in time at which retrieval rod **16*b* has been moved along cover slot 46, past blocking-activating member 24 of lever 22, forcing the blocking-activating member out of passageway 40, simultaneously moving passageway blocking member 26 into the passageway. As shown, cylinder rod 38 has forced piston 34 to the bottom of the cylinder 32 against the urging of spring 30. Rod 16*b* has been lowered in the Figure so that its holding implement 18 is adjacent access opening 52, allowing the roll of mint 20** to be removed therefrom.

After retrieval rod **16*b* has been moved past blocking-activating member 24, the lever begins to slowly rotate counterclockwise, urged by spring 30 against the retarding influence of dashpot 33 until the passageway blocking member 26 has been removed from article transport passageway 40, and blocking-activating member 24 has re-entered the passageway. The urging of spring 30 on the lever 22 is delayed by the time required to admit air through adjustable orifice 36, necessary to allow piston 34 to rise in cylinder 32 and thereby lift the cylinder rod 38 so that the lever 22 can pivot to its original position. During the time when passageway blocking member 26 is positioned in the article transport passageway 40, the empty holding implement 18 at the end of retrieval rod 16*b*** is able to move back past the passageway blocking member into the container, but movement of the retrieval rod with mints held in the implement is prevented by the passageway blocking member, as is more clearly seen in FIG. 4. The passageway blocking member 26 is limited in its blocking movement due to the fact that further clockwise movement of lever 22 is prevented as a consequence of the attachment of the lever to cylinder rod 38, which itself is incapable of further downward movement because of the positioning of the piston 34 against the bottom of cylinder 32.

The rate at which air is admitted to the cylinder 32 is controlled by the space between the piston 34 and the cylinder wall, as well as by the adjustable orifice 36. The orifice can be positioned to allow greater or lesser flows of air into the cylinder 33, for example, the air flow can be adjusted to allow delays of up to 60 seconds or longer. Typically, the orifice will be adjusted to provide a delay sufficient to discourage individuals from waiting for the passageway blocking member 26 to leave the passageway 40 so that another article can be removed from the container.

The dimensions of the container, and the components thereof, may be varied within whatever limits are desired, and will depend among other things upon the size of the articles being dispensed, the space available for locating the container, and similar factors. Commonly, however, the height of the container will be about 12 to 18 inches, and it will have a diameter of from about seven to 12 inches. The article transport passageway can be fabricated in a variety of transverse, cross-sectional shapes, a U-shaped, channel-like form being preferred with a slot disposed in the bottom thereof, as shown more particularly in FIG. 4. When such a configuration is employed, and in the case of dispensing articles such as the roll of mints described, the U-shaped channel will be about one inch high and about one inch wide, and will have a slot approximately ⅛th inch wide at the bottom thereof. The dimensions will be selected so that access by the passageway blocking member and unblocking-activating member will have access far enough into the interior of the article transport passageway so that travel of the holding implement supporting an article to be dispensed will necessarily have to come into contact with such members.

Since the article access shaft 42 simply serves as a guide to bring the retrieval rod adjacent to the access opening 52, its dimensions are not critical, it only being necessary that the dimensions be such that the holding implement and the article held thereby can be accommodated in the chute.

FIG. 3 is a top view of the container of FIG. 1. In the Figure, container 12 is shown with the cover 14 positioned at the top thereof. The cover 14 has a cover slot 44 positioned therein, the article transport passageway being fastened adjacent the cover by means of mounting screws 29. Lever 22, pivotable about pivot 28 is visible through the slot 46, the slot terminating on each end in an enlarged circular opening having a dimension sufficient to accommodate the larger diameter portion of the retrieval rod, enabling such portion to be lowered therethrough during the act of securing the dispensed articles to the holding implement 18. A retrieval rod having both greater and smaller diameter portions is sometimes preferred so that the shoulder formed at the point where the different diameters meet can rest upon slot 46, as better seen in FIG. 4. The provision of such a shoulder is not necessary, however, in which case enlargement of the ends of the slot may be omitted. Also shown in the Figure in phantom are retrieval rod 16 with holding implement 18 located at the lower end thereof securing a roll of mints 20, other rolls of mints being disposed about the floor of the container.

Figure 4:
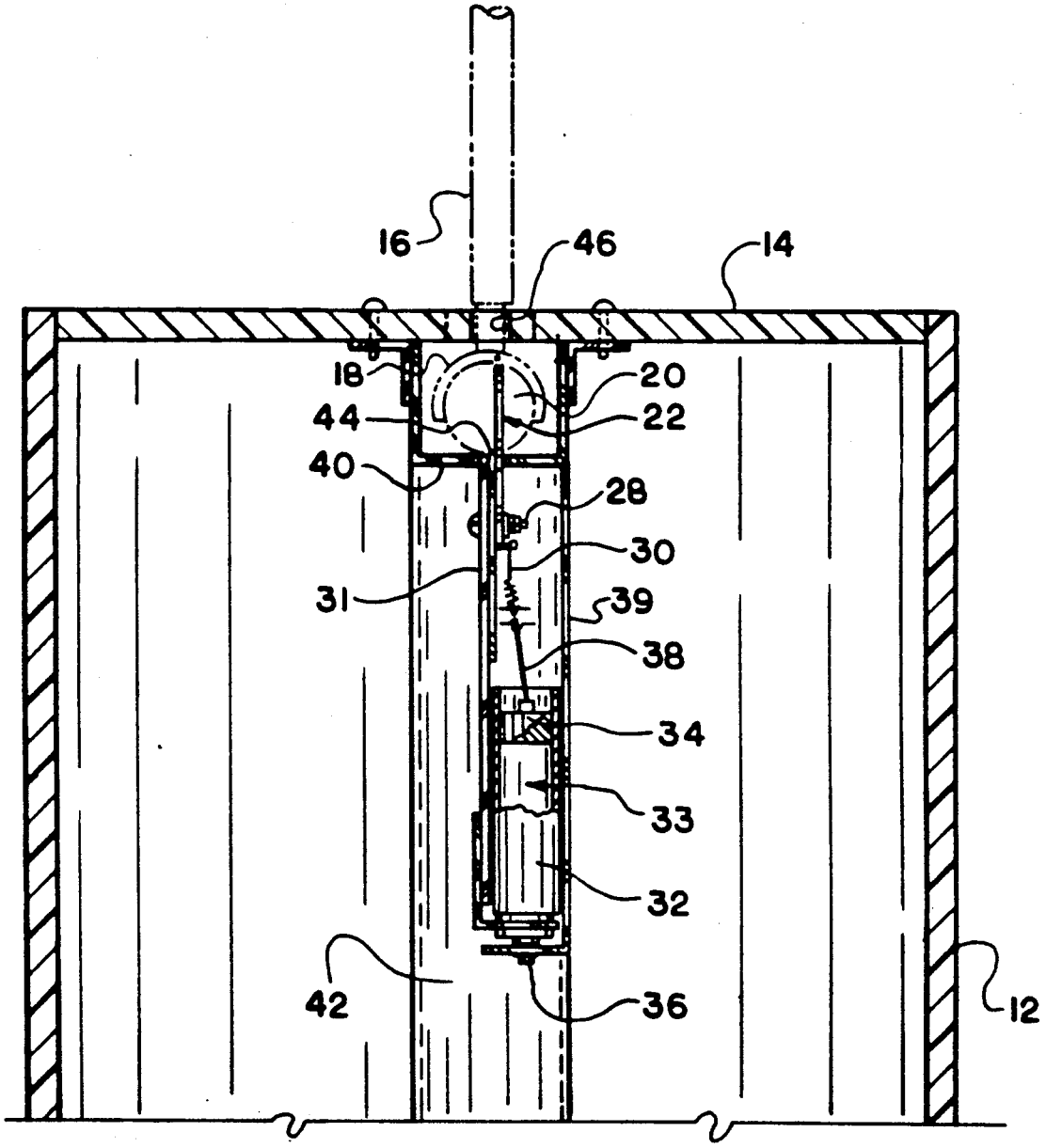
FIG. 4 is a partial end elevation view of the container of FIG. 1 showing an article in the process of being withdrawn therefrom.

FIG. 4 is a partial end elevational view of the container of FIG. 1 showing an article 20, in phantom, in the process of being withdrawn therefrom. Also shown, in phantom, is a retrieval rod 16 having a larger diameter upper portion, and a smaller diameter lower portion located in cover slot 46, the shoulder formed at the juncture of the two diameters resting upon cover 14 to facilitate positioning of the holding implement and the article supported by it in the article transport passageway 40. When positioned in the passageway, it can be seen that the roll of mints 20 is forced into engagement with the members associated with lever 22 extending through passageway slot 44, forcing a pivoting movement of the lever as the retrieval rod is moved through the passageway. The relationship of the pivot point 28 to the lever and the connection of the lever to cylinder rod 38, attached to piston 34 in cylinder 32, is also clearly shown, as are further details of the alignment of article transport passageway 40 and article access shaft 42.

While in the preferred mode, the retrieval rod 16 is round, it can alternatively be provided with a square or rectangular cross-section, if desired. Also if desired, a delay mechanism-protecting panel 39 can be attached to cover the delay mechanism as shown.

The cover 14 is secured to the article transport passageway 40, the latter being in turn connected to article access shaft 42 which is fastened to the bottom of the container by mounting screws 45, the interconnection described tending to discourage unauthorized entry into the container. Other methods for securing the cover to the container well-known to the art may also be employed.

The materials of the container are relatively unimportant, however, it is preferred that the top cover be transparent so that an individual using the container can see to move the retrieval rod 16 to the article which it is desired to remove from the container. Various materials may be employed including metal, plastic, cardboard and others. In view of the desirability of being able to see through the top of the container, fabrication of the cover from transparent plastic materials, for example, plexiglass, is of advantage.

Figure 5:
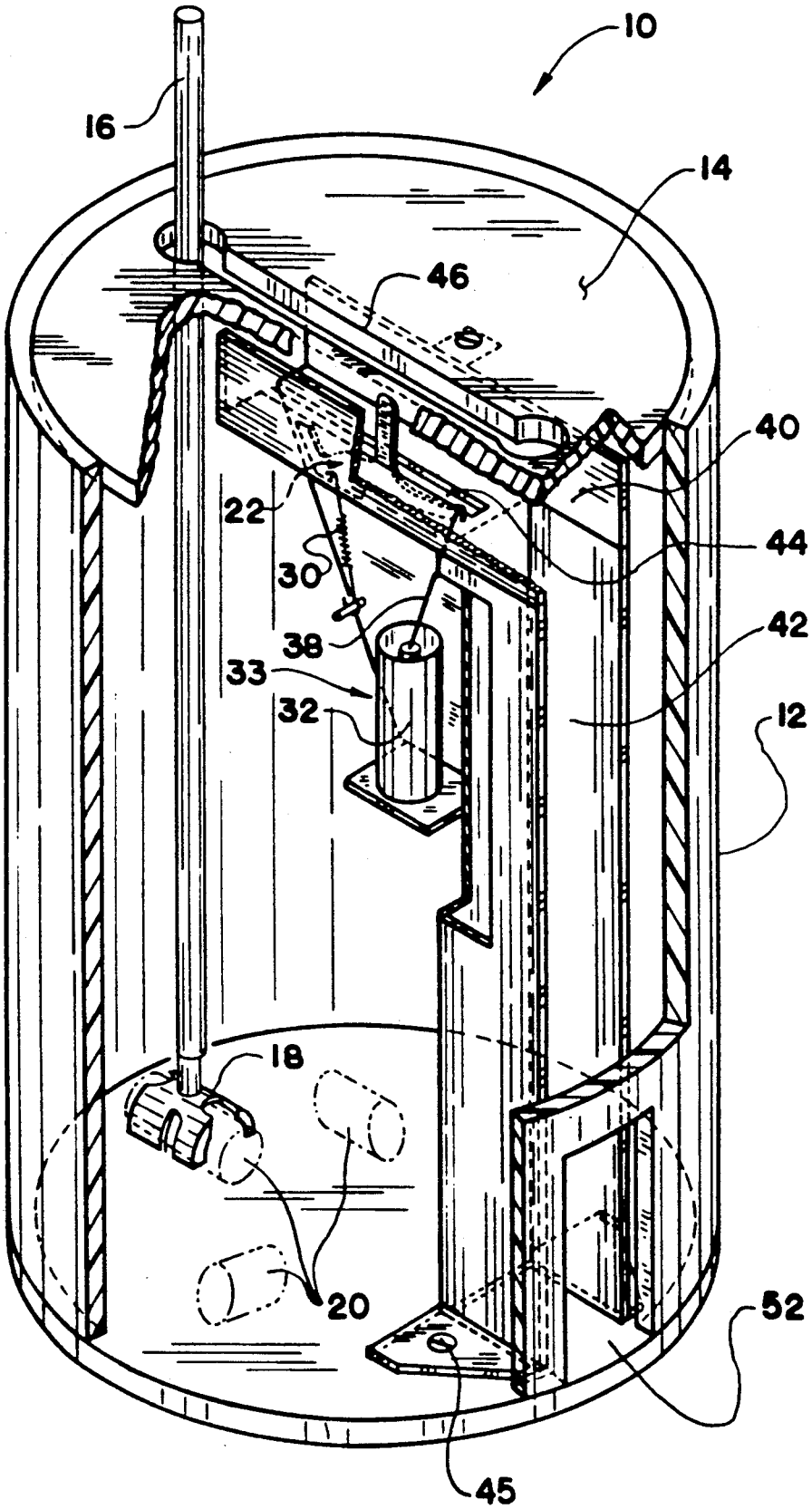
FIG. 5 is an isometric view of the limited access container of the invention.

FIG. 5 is an isometric view of the limited access container of the invention. The Figure illustrates more clearly the relationship of the various components making up the dispensing device 10. In the Figure can be seen the retrieval rod 16 extending through the cover slot 46 into the interior of the container where the holding implement 18 on the bottom thereof has access to the rolls of mints 20. Immediately beneath the cover 14 and connected thereto is article transport passageway 40, the passageway being provided with a passageway slot 44 in the bottom thereof through which the passage blocking member and blocking-activating members pass. In the Figure, spring 30, attached to lever 22, urges the lever in a counterclockwise direction, being dampened in such movement by dashpot 33 which is connected to lever 22 by means of cylinder rod 38. The article access shaft 42, fastened to the bottom of the container by mounting screws 45, also shown having a U-shaped transverse cross-section, is located adjacent access opening 52.

While the article-holding implement on retrieval rod 16 is shown in the Figure as a semi-circular clip, it may take other forms, including a pressure-sensitive adhesive member adapted to temporarily engage and hold articles thereto, or some other equivalent configuration.

The device described in the preceding not only provides an efficient means for limiting the number of samples distributed to any particular individual, but it also lends itself to the placement of advertising material around the container, which can be made to simulate the goods being dispensed, for example, a roll of mints.

While in accordance with the Patent Statutes, a preferred embodiment and best mode has been presented, the scope of the invention is not limited thereto, but rather is measured by the scope of the attached claims.

What is claimed is:

1. A limited access container that controls the rate of withdrawal of articles therefrom comprising:

a limited access container;

article transport means;

article blocking means;

spring means; and unblocking delay means, wherein to withdraw articles from the container, the articles must be removed by said transport means along a passageway in said container to an opening communicating with the outside, said article blocking means being pivotal from a blocking position preventing movement of said articles through said passageway, to an unblocking position permitting said movement, the movement of said articles through the unblocked passageway pivoting said article blocking means into an article blocking position, said spring means automatically pivoting said blocking means back to an article unblocking position after an interval of time determined by said unblocking delay means has elapsed, and wherein said unblocking delay means comprises a dash pot and said article transport means comprises a rod having an article-holding implement fixed to the lower end thereof, and said container has a top cover provided with a slot passing through the center thereof dimensioned to receive the rod which extends therethrough.

2. A limited access container that controls the rate of withdrawal of articles therefrom comprising:

a limited access container;

article transport means;

article blocking means;

spring means; and unblocking delay means, wherein to withdraw articles from the container, the articles must be moved by said transport means along a passageway in said container to an opening communicating with the outside, said article blocking means being pivotal from a blocking position preventing movement of said articles through said passageway, to an unblocking position permitting said movement, the movement of said articles through the unblocked passageway pivoting said article blocking means into an article blocking position, said spring means automatically pivoting said blocking means back to an article unblocking position after an interval of time determined by said unblocking means has elapsed, wherein said article blocking means comprises a pivotable lever having a passageway blocking member adjacent a first end thereof, and a blocking-activating member adjacent a second end thereof, said lever being pivotable about a pivot point between a first positioning which said blocking member extends into said passageway in an article-blocking position, and a second position in which said passageway is unblocked by the removal of said blocking member therefrom and in which said blocking-activating member is moved into said passageway, said first end being connected to said spring means which urges said lever to pivot into an unblocking position, and said second end being connected to said unblocking delay means for delaying said pivoting, and wherein further, the movement of said articles past said blocking-activating member pivot said lever against the urging of said spring, locating said blocking member in its blocking position, and the urging of said spring thereafter repositions said blocking member in its unblocking position after the elapse of an interval of time determined by said unblocking delay means following movement of said articles through said passageway.

3. A limited access container according to claim 2 wherein at least a portion of said passageway has a U-shaped transverse cross-section, the bottom of which is provided with a slot along its longitudinal axis adapted to receive said members therethrough.

4. A limited access container according to claim 3 wherein said article transport means comprises a rod having an article-holding implement fixed to its lower end, said container having a transparent top cover provided with a slot passing through the center thereof dimensioned to receive said rod, and said U-shaped passageway is disposed immediately below said cover.

5. A limited access container according to claim 4 wherein said implement comprises a semi-circular clip adapted to hold said articles.

6. A limited access container according to claim 5 in which the vertical distance between the bottom of said cover and the bottom of said passageway is dimensioned to force said articles to contact said members when the articles are passed through said passageway.

7. A limited access container according to claim 6 in which said U-shaped passageway is connected at right angles to a U-shaped chute extending to the bottom of said container through which said rod can be lowered after passing through said passageway to a location where said article-holding implement is positioned adjacent to an access opening located at the bottom of said container.

8. A limited access container that controls the rate of withdrawal of articles therefrom comprising:

a limited access container;

article transport means;

article blocking means;

spring means; and unblocking delay means, wherein said article blocking means comprises a pivotable lever having a passageway blocking member and a blocking-activating member, said lever being pivotable about a pivot point, and said lever being connected to said spring means which urges said lever to pivot into an unblocking position, said lever also being connected to said unblocking delay means for delaying said pivoting;

wherein said unblocking delay means comprises a pneumatic dashpot; and wherein said article transport means comprises a rod having an article-holding implement fixed to its lower end, said container having a top cover provided with a slot passing through the center thereof dimensioned to receive said rod; and wherein further, articles withdrawn from said container must be moved by said article transport means through a passageway in said container to an opening communicating with the outside, thereby causing said lever to pivot into a blocking position where it remains for a period determined by said unblocking delay means, said passageway being disposed immediately below said top and structured to receive said members on the interior thereof.

9. A limited access container according to claim 8 in which said passageway is horizontal and U-shaped, and is connected to a vertical U-shaped chute extending to the bottom of said container where an access opening to the outside is located in said container.

10. A limited access container according to claim 9 in which the vertical distance between the top and the bottom of said passageway is dimensioned to force said articles to contact said members when the articles are passed through said passageway.

* * * * *